US006687912B2

(12) United States Patent
Collins et al.

(10) Patent No.: US 6,687,912 B2
(45) Date of Patent: Feb. 10, 2004

(54) BASEBALL CATCHER'S SHIN GUARD

(75) Inventors: Gregory James Collins, Loretto (CA); Kenneth W. Nimmons, Litchfield, IL (US)

(73) Assignee: HOS Development Corporation, Litchfield, IL (US)

( * ) Notice: Subject to any disclaimer, the term of this patent is extended or adjusted under 35 U.S.C. 154(b) by 0 days.

(21) Appl. No.: 09/846,892

(22) Filed: May 1, 2001

(65) Prior Publication Data

US 2002/0162153 A1 Nov. 7, 2002

(51) Int. Cl.[7] ..... A41D 13/00
(52) U.S. Cl. ..... 2/22
(58) Field of Search ..... 2/455, 22, 24, 2/62, 16, 44, 45, 908, 911; 128/878, 882; 602/20, 23, 26, 62

(56) References Cited

U.S. PATENT DOCUMENTS

| | | | | |
|---|---|---|---|---|
| 833,546 | A | | 10/1906 | Pierce |
| 2,440,664 | A | | 4/1948 | Irons |
| 2,976,539 | A | | 3/1961 | Brown, Jr. |
| 2,982,968 | A | * | 5/1961 | Groot ..... 2/22 |
| 3,208,080 | A | | 9/1965 | Hirsch |
| 3,248,738 | A | | 5/1966 | Morgan |
| 3,348,236 | A | | 10/1967 | Copeland |
| 3,898,697 | A | * | 8/1975 | Whitehead ..... 2/22 |
| 3,945,042 | A | | 3/1976 | Lobo |
| 4,292,263 | A | | 9/1981 | Hanrahan et al. |
| 4,307,471 | A | | 12/1981 | Lovell |
| 4,325,148 | A | | 4/1982 | Livernois |
| D264,140 | S | | 5/1982 | Jenkins |
| 4,453,271 | A | | 6/1984 | Donzis |
| 4,484,360 | A | | 11/1984 | Leighton et al. |
| 4,507,801 | A | | 4/1985 | Kavanagh et al. |
| 4,538,301 | A | | 9/1985 | Sawatzki et al. |
| 4,580,408 | A | | 4/1986 | Stuebner |
| D284,038 | S | | 6/1986 | Eghamn et al. |
| 4,633,529 | A | | 1/1987 | Litz |
| 4,642,814 | A | | 2/1987 | Godfrey |
| 4,677,698 | A | | 7/1987 | Angas |
| 4,680,813 | A | | 7/1987 | Glaeser |
| 4,685,155 | A | | 8/1987 | Fingerhut et al. |
| 4,688,269 | A | | 8/1987 | Maeshima |
| 4,692,946 | A | | 9/1987 | Jurga |
| 4,700,407 | A | | 10/1987 | Mattila |
| 4,788,972 | A | | 12/1988 | DeBusk |
| 4,810,559 | A | | 3/1989 | Fortier et al. |
| 4,825,476 | A | | 5/1989 | Andrews |
| 4,876,745 | A | | 10/1989 | Richards |
| 4,884,295 | A | | 12/1989 | Cox |
| 4,888,826 | A | | 12/1989 | Parsons, Jr. et al. |
| 4,926,503 | A | | 5/1990 | Wingo Jr |
| D310,278 | S | | 8/1990 | Quinlan |
| 4,959,875 | A | * | 10/1990 | Moon ..... 2/22 |
| D311,977 | S | | 11/1990 | Eghamn |

(List continued on next page.)

FOREIGN PATENT DOCUMENTS

| | | |
|---|---|---|
| DE | 34 01 111 | 7/1985 |

OTHER PUBLICATIONS

Schutt Sports Catalog, published by Schutt Sports, Aug., 1999, pp. 1–105.

*Primary Examiner*—Tejash Patel
(74) *Attorney, Agent, or Firm*—Brinks Hofer Gilson & Lione

(57) ABSTRACT

A shin guard that includes a shell having a first surface and a second surface that face each other and define a concave interior volume of space that extends along a longitudinal dimension of the shell. A leg support includes a first end attached to the shell and a second free end that extends past the first surface and lies over the concave interior volume of space, wherein the leg support does not engage the second surface.

38 Claims, 5 Drawing Sheets

U.S. PATENT DOCUMENTS

| | | | | | |
|---|---|---|---|---|---|
| 4,982,447 | A | | 1/1991 | Henson | |
| 4,999,847 | A | | 3/1991 | Barcelo | |
| 5,007,108 | A | | 4/1991 | Laberge et al. | |
| 5,016,621 | A | * | 5/1991 | Bender | 2/22 |
| 5,086,761 | A | | 2/1992 | Ingram | |
| 5,146,621 | A | | 9/1992 | Hadar et al. | |
| 5,274,846 | A | | 1/1994 | Kolsky | |
| 5,417,647 | A | | 5/1995 | Down | |
| 5,423,087 | A | | 6/1995 | Krent et al. | |
| D361,869 | S | | 8/1995 | Paffett et al. | |
| 5,450,625 | A | * | 9/1995 | Hu | 2/16 |
| 5,452,475 | A | | 9/1995 | Hunt | |
| D374,746 | S | | 10/1996 | Skottheim | |
| 5,561,857 | A | | 10/1996 | Hoshizaki et al. | |
| 5,628,063 | A | | 5/1997 | Reed | |
| D381,131 | S | | 7/1997 | Duback et al. | |
| 5,652,956 | A | * | 8/1997 | Hoshizaki et al. | 2/22 |
| D389,959 | S | | 1/1998 | Collins et al. | |
| D392,074 | S | | 3/1998 | Witkin | |
| 5,732,411 | A | * | 3/1998 | Coleman et al. | 2/22 |
| 5,742,938 | A | | 4/1998 | Winningham et al. | |
| 5,794,261 | A | | 8/1998 | Hefling | |
| 5,829,055 | A | * | 11/1998 | Collins et al. | 2/22 |
| 5,943,695 | A | | 8/1999 | Yen | |
| 6,058,504 | A | * | 5/2000 | Tollini | 2/22 |
| 6,173,448 | B1 | * | 1/2001 | Kroposky | 2/22 |
| 6,317,888 | B1 | * | 11/2001 | McFarlane | 2/24 |

* cited by examiner

Fig. 4
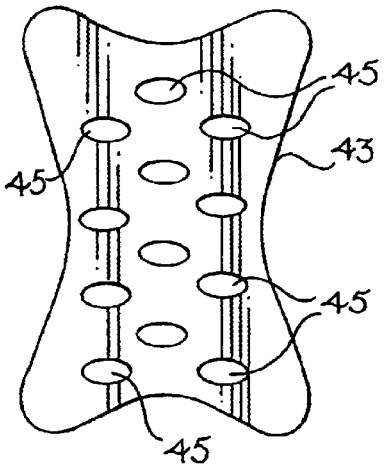
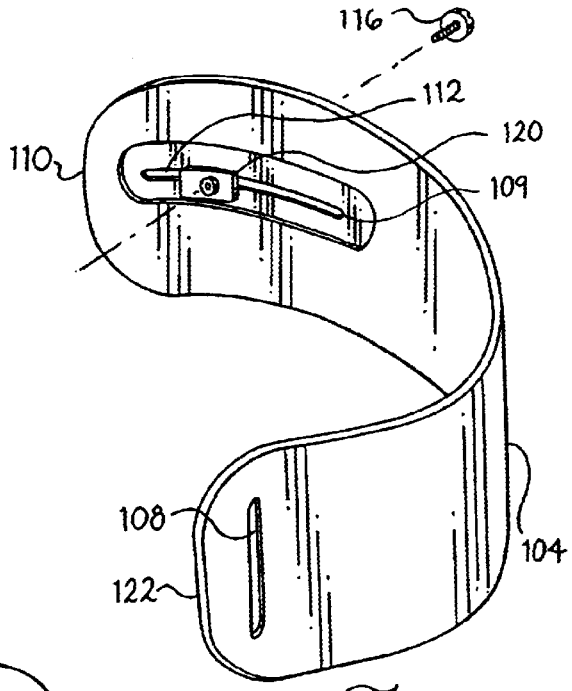
Fig. 5
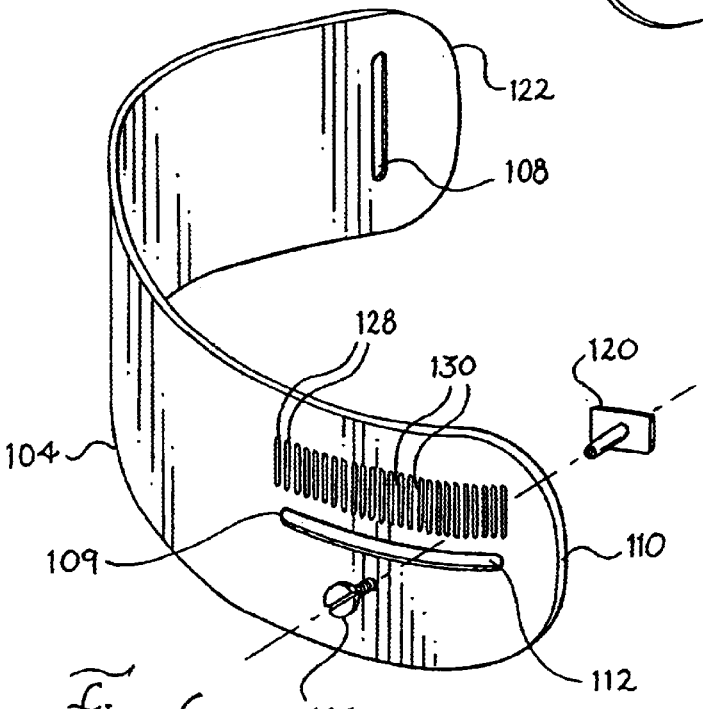
Fig. 6

BASEBALL CATCHER'S SHIN GUARD

BACKGROUND OF THE INVENTION

1. Field of the Invention

This invention relates to shin guards for wearing during sports play and more particularly to shin guards worn by catchers during the play of baseball or softball.

2. Discussion of Related Art

A shin guard is commonly used and is required for league play in baseball and softball, as a hard thrown baseball pitch or bat deflected ball striking a catcher's unprotected leg, knee, shin, ankle or foot may cause severe injury. Besides providing protection, the shin guard is often used in conjunction with the leg of the catcher, to intentionally block a base runner from reaching home while sliding into home plate.

Known shin guards typically include: 1) a hard exterior shell that covers the lower leg of the catcher, 2) a kneecap shell that covers the kneecap of the catcher, 3) an upper kneecap shell that covers a portion of the catcher's thigh located just above the kneecap and 4) a foot guard that covers a portion of the catcher's foot. The exterior shell, kneecap shell, upper kneecap shell and foot guard are attached to one another to form a single unit. The exterior shell, kneecap shell, upper kneecap shell and foot guard are movable relative to one another so that they cover the leg of the catcher as he or she moves from a stand-up position to a crouch position and vice-versa.

Such a known shin guard is attached to the leg of the catcher by inserting the leg into a concave-like cavity formed by the various shells and the foot guard. Next, a plurality of straps that are attached to one side of the shin guard are wrapped around the rear portions of the leg and attached to D-rings located at the other side of the shin guard. It is common that the attachment includes two separate straps that are criss-crossed relative to one another so their clips engage two separate D-rings arranged at the other side of the shin guard. Criss-crossing the straps helps to support the leg. One disadvantage of using such straps is that their attachment can be difficult. A second disadvantage is that the use of two clips on each shin guard increases the possibility that a clip on one shin guard engages a strap on the other shin guard. A third disadvantage of using such straps is that it is often difficult to adjust the straps to adapt to different leg thicknesses. In addition, crisscrossing the straps often results in the straps being twisted which can result in discomfort to the catcher when the shin guard is worn.

Accordingly, it is an object of the present invention to improve the attachment of a shin guard to a leg.

A second object of the present invention is to reduce the possibility of a clip from one shin guard engaging a strap of another shin guard.

A third object of the present invention is to improve the comfort level and/or support provided by a shin guard to a leg.

SUMMARY OF THE INVENTION

One aspect of the present invention regards a shin guard that includes a shell having a first surface and a second surface that face each other and define a concave interior volume of space that extends along a longitudinal dimension of the shell. A V-shaped strap that includes a first free end attached to the first surface, a second free end attached to the first surface and an apex positioned between the first free end and the second free end and attached to the second surface.

A second aspect of the present invention regards a shin guard that includes a shell having a first surface and a second surface that face each other and define a concave interior volume of space that extends along a longitudinal dimension of the shell. A movable leg support includes a first end attached to said shell and a second free end, wherein the leg support moves relative to the shell from a first position to a second position where the second free end extends past the first surface and lies over the concave interior volume of space.

A third aspect of the present invention regards a shin guard that includes a shell having a first surface and a second surface that face each other and define a concave interior volume of space that extends along a longitudinal dimension of the shell. A leg support includes a first end attached to the shell and a second free end that extends past the first surface and lies over the concave interior volume of space, wherein the leg support does not engage the second surface.

A fourth aspect of the present invention regards a shin guard that includes a shell having a first surface and a second surface that face each other and define a concave interior volume of space that extends along a longitudinal dimension of the shell and a heat/sweat absorber positioned within the concave interior volume of space.

A fifth aspect of the present invention regards a shin guard that includes a shell having a first surface and a second surface that face each other and define a concave interior volume of space that extends along a longitudinal dimension of the shell. A kneecap shell is attached to the shell and a kneecap insert attached to the kneecap shell.

A sixth aspect of the present invention regards a method of attaching a shin guard to a leg of a person by inserting a leg into a shell of a shin guard, the shell including a first surface and a second surface that face each other and define a concave interior volume of space that extends along a longitudinal dimension of the shell and into which the leg is inserted. The method further including moving a leg support attached to the first surface of the shin guard so that a free end of the leg support snugly engages the inserted leg, wherein the leg support does not engage the second surface.

Each aspect of the present invention provides the advantage of improving the attachment of a shin guard to a leg.

Each aspect of the present invention provides the advantage of reducing the possibility of a clip from one shin guard engaging a strap of another shin guard.

Each aspect of the present invention provides the advantage of improving the comfort level and/or support provided by a shin guard to a leg.

The foregoing features and advantages of the present invention will be farther understood upon consideration of the following detailed description of the invention taken in conjunction with the accompanying drawings, in which:

BRIEF DESCRIPTION OF THE DRAWINGS

FIG. 4 shows a front view of an embodiment of a heat/sweat absorber to be used with the shin guard of FIG. 1;

FIG. 5 shows a front perspective and partially exploded view of an embodiment of a leg support to be used with the shin guard of FIG. 1;

FIG. 6 shows a rear perspective and partially exploded view of the leg support of FIG. 5.

DESCRIPTION OF THE PREFERRED EMBODIMENT

Figure 1:
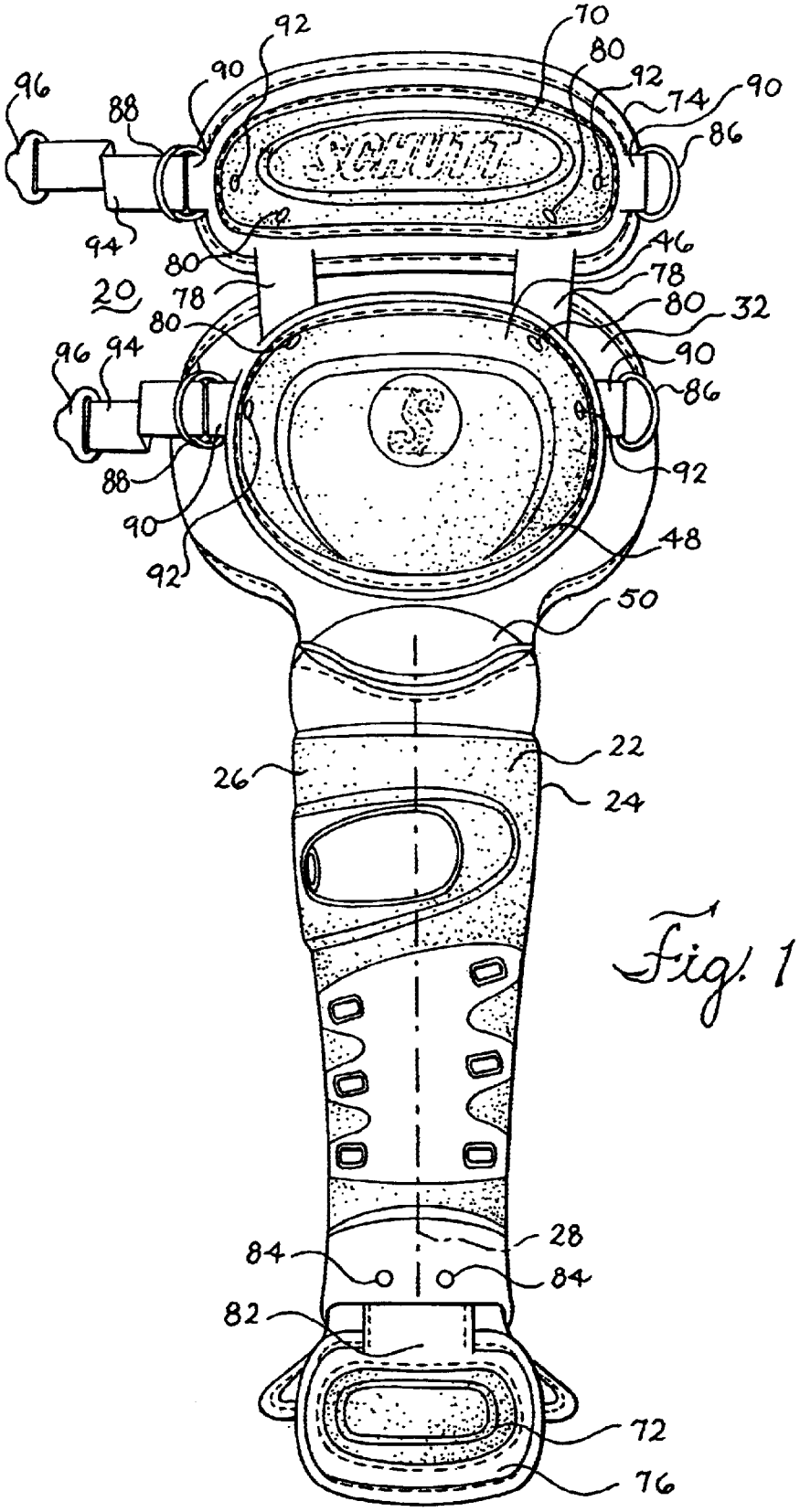
FIG. 1 shows a front view of an embodiment of a shin guard according to the present invention.

Referring now to the drawings wherein like reference characters designate identical or corresponding parts throughout the several figures, and in particular FIGS. 1–7 show an embodiment of a shin guard 20 that is designed to be worn on a person's left leg. It is understood that the corresponding shin guard designed to be worn on a person's right leg has the same components as the shin guard 20 except that the right leg shin guard will be a mirror image of the left leg shin guard 20.

Figure 2:
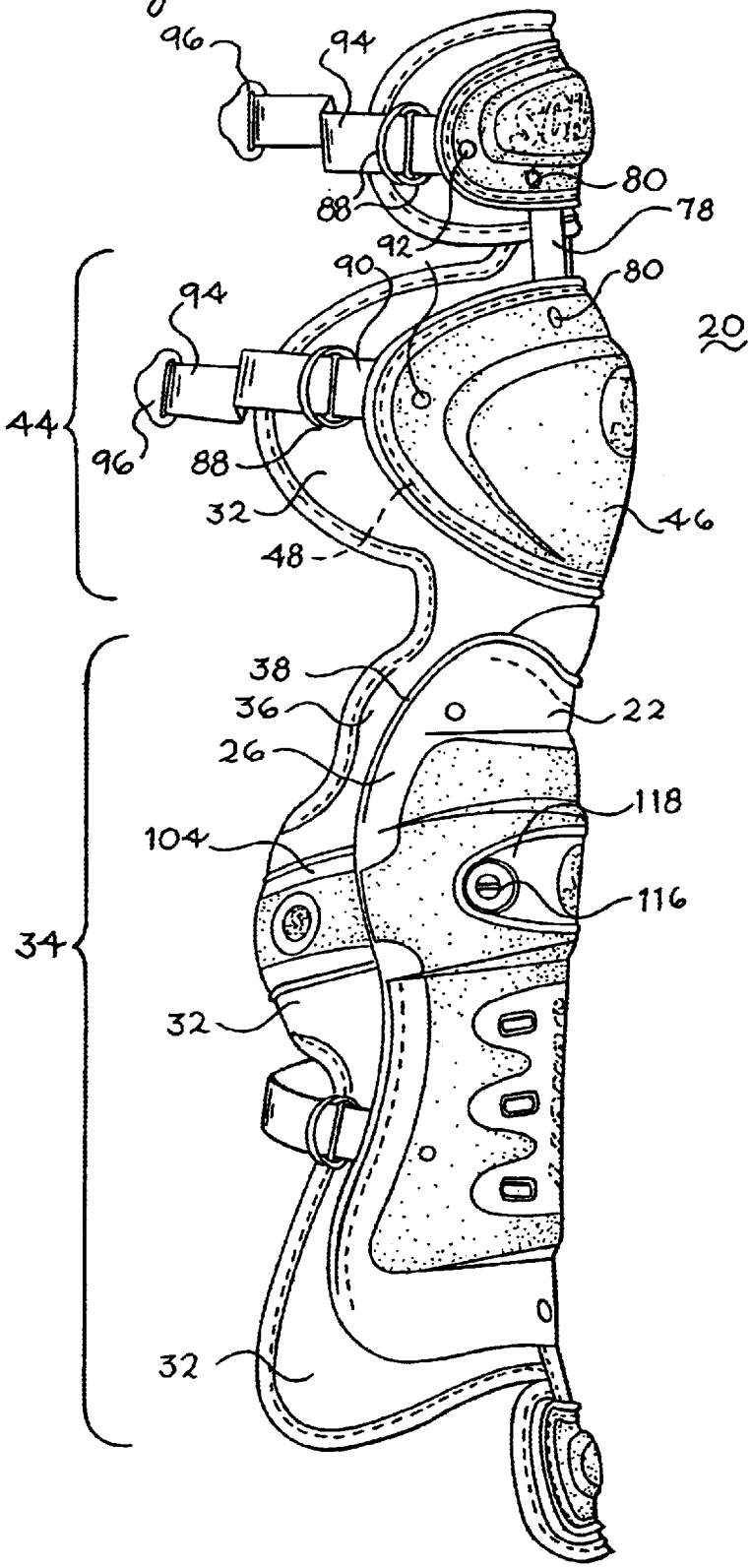
FIG. 2 shows a side view of the shin guard of FIG. 1.

As shown in FIGS. 1 and 2, the shin guard 20 includes a hard exterior shell 22 that defines a left side surface 24 and a right side surface 26 that are separated form one another by an imaginary longitudinal line 28 that extends along the longitudinal dimension of the shell 22. As shown by the rear view of FIG. 3, the left side surface 24 and the right side surface 26 are curved so that they face one another and define a concave interior volume of space 30 that extends along a longitudinal dimension of the shell 22. The exterior shell 22 is preferably made of a durable material, such as injection molded plastic.

Figure 3:
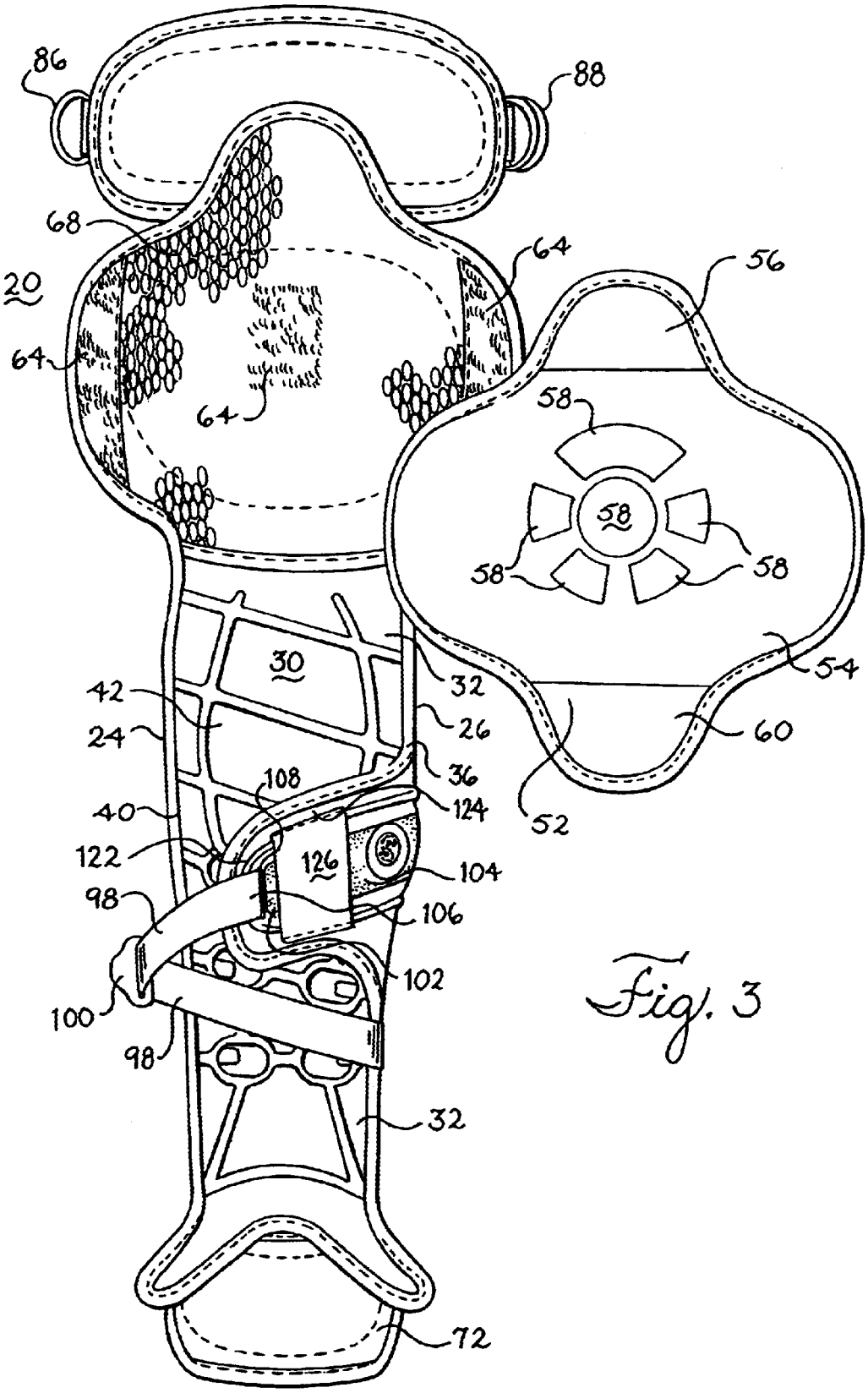
FIG. 3 shows a rear view of the shin guard of FIG. 1.

As shown in FIGS. 2 and 3, a bottom section of a molded liner 32 is positioned within the concave interior volume of space 30. The molded liner 32 is sewn to the exterior shell 22 along the sides and top of the shell 22. Such sewing provides a sturdy attachment between the molded liner 32 and the exterior shell 22. As shown in FIGS. 1–3, the bottom section 34 of the molded liner 32 has a shape that is similar to that of the exterior shell 22. The bottom section 34 is larger than the exterior shell as shown by the fact that a right side portion 36 extends past the edge 38 of the right side surface 26 by approximately 1.75 inches so as to lie outside of the concave interior volume of space 30. Similarly, a left side portion 40 extends past the edge of the right side surface 26 by approximately 1.75 inches so as to lie outside of the concave interior volume of space 30. Note that the molded liner 32 is made of a nylon fabric pothole mesh pouch 42 with a pattern of circular holes into which three layers of padding material with holes are inserted. The layers of padding material are bonded to one another where each layer is approximately ¼" thick. An example of the padding material is thermoformed foam.

Note that a heat/sweat absorber 43 with multiple openings 45, as shown in FIG. 4, may be positioned within the concave interior volume of space 30 and attached, via one or more hook and hoop systems known by the trademark VELCRO, to the portion of the liner 32 facing away from the shell 22. Once attached, the heat/sweat absorber 43 is positioned and dimensioned so as to abut a substantial portion of the front of the lower leg of the wearer of the shin guard 20. An example of a suitable heat/swear absorber is sold under the trade name CoolMax.

The molded liner 32 also includes a top section 44. As shown in FIGS. 1 and 2, a hard kneecap shell 46 is attached to the top section 44 of the molded liner 32. The kneecap shell 46 preferably is made of a durable material, such as injection molded plastic. Attachment is accomplished by sewing the edge 48 of the kneecap shell 46 to the molded liner 32. With such attachment, the kneecap shell 46 is indirectly attached to the exterior shell 22 via the molded liner 32. A bottom edge of the kneecap shell 46 is separated from a top edge of the exterior shell 22 by approximately 1.5" so that the kneecap shell 46 does not overlap the exterior shell 22. In order to provide additional protection in the area between the kneecap shell 46 and the exterior shell 22, an oval-shaped pad 50 may be sewn to the top, interior surface of the exterior shell 22 so that a portion of the pad 50 extends from the top edge of the shell 22 to a bottom edge of the kneecap shell 46 when the shin guard is an unbent orientation. The pad 50 preferably is made of foam that is covered by fabric.

Note that further protection for the knee of the catcher may be provided by attaching a kneecap insert 52 to the kneecap shell 46 as shown in FIG. 3. The kneecap insert 52 includes a base 54 made of a furry fabric. Either a single pad or a top foam pad 56, a plurality of central foam pads 58 and a bottom foam pad 60 are inserted into the interior of the base 54 and sewn onto the interior surface of the base 54. The pads are preferably 0.25-inch thick portions of neoprene. The kneecap insert 52 is attached to the kneecap shell 46 by pressing the central foam pads 58 the base 54 onto attachment systems 64 attached to the sides and center of the top section 44 of the liner 32. An example of a suitable attachment system is a rectangular hook system, sold under the trademark VELCRO, that engages the fury fabric of the exterior surface of the base 54, and which acts as a loop system. The rectangular hook systems 64 are sewn to a knee lining 68. Note that the kneecap insert 52 is attached adjacent the top section 44 of the liner 32. The kneecap insert 52 has a sufficient size so that it almost entirely covers the interior of the top section 44 and the bottom foam pad 60 is positioned over a top portion of the bottom section 34 of the liner 32.

Additional protection for the catcher's leg is provided by a hard upper kneecap shell 70 and a toe guard 72 of the shin guard 20. The upper kneecap shell 70 and the toe guard 72 are each made of a durable material, such as injection molded plastic. A liner 74 is placed in the interior of the upper kneecap shell 70 and sewn to edges of the shell 70. Similarly, a liner 76 is placed in and attached to the interior of the toe guard 72. The liners 74 and 76 preferably are made in the same manner as the liner 32 by placing a foam material within the interior of a fabric pothole mesh pouch.

As shown in FIGS. 1 and 2, the upper kneecap shell 70 is attached to kneecap shell 46 by a pair of vinyl straps 78. The ends of the straps 78 are inserted between the liner 74 and shell 70 and liner 32 and shell 46 and then rivets 80 are applied to attach the straps 78 to the shells 46 and 70. The end result is that the upper kneecap shell 70 is indirectly attached to the liner 32 via rivets 80 and shell 46, which is attached to the liner 32.

As shown in FIGS. 1 and 2, the toe guard 72 is attached to the shell 22 by a single vinyl strap 82. The ends of the strap 82 are inserted between the liner 76 and toe guard 72 and liner 32 and shell 22 and then rivets 84 are applied to attach the strap 82 to the shell 22. The strap 82 is also sewn to the toe guard 72. The end result is that the toe guard 72 is indirectly attached to the liner 32 via strap 82 and rivets 84 and shell 22, which is attached to the liner 32.

The shin guard 20 includes several components for attaching the shin guard 20 to the leg of the catcher. As shown in FIGS. 1–3, single D-rings 86 and double D-rings 88 are contained within loops 90 that are placed between the shells 46 and 70 and their respective liners 32 and 74. The loops 90 are attached to the shells and liners via rivets 92. Elastic straps 94 are inserted through the double D-rings 88. The elastic straps 94 have metal clips 96 attached at a free end thereof.

The strapping and attachment of the shin guard to the leg is novel. As you can see, the invention replaces the two separate straps used by prior shin guards with a single strap 98 that is V-shaped. The free ends of the V are attached to one side or surface of the shin guard and a metal clip 100 is attached at the vertex V of the strap 98 that lies between the two free ends of the strap 98. The single clip 100 is then attached to a single D-ring (not shown) attached to the other side of the shin guard 20 in a manner similar to D-rings 86 described previously. Thus, the vertex V is attached to the other side or surface of the shin guard 20. Elimination of the extra strap reduces the risk that the straps of the left and right shin guards will engage one another during movement of the catcher.

As shown in FIG. 3, the V-shaped strap 98 is inserted into a movable leg support 104. In particular, an upper free end 106 of the strap 98 is inserted into a rectangular opening 108 located at a free end 102 of the leg support 104 and attached to the underside of the leg support 104 by a rivet (not shown) positioned near an end 109 of a slot 112.

As shown in FIGS. 2–3 and 5–7, the leg support 104 is curved and made of a resilient material, such as injected molded plastic. The leg support 104 has a width of approximately 2⅛ inches and a length of approximately 7.5 inches. A portion of the leg support 104 is inserted into a recessed area of the shell 22 so that twisting of the leg support 104 is reduced. The portion within the recessed area has a curvature that matches that of the shell 22. As will be explained later, the curvature of the leg support 104 is chosen so as to snugly engage a number of sizes for a calf of a player's leg. One end 110 of the leg support 104 has a rectangular slot 112 that has a length of approximately 1.5 inches and extends along a portion of the length of the leg support 104.

A locking mechanism 114 attaches the end 110 of the leg support 104, via the slot 112, to the shell 22. The locking mechanism 114 includes a pressing element, such as a screw 116, that has an end inserted through an injected-molded plastic washer 118 formed in the shell 22 and through the slot 112. The inserted end of the screw 116 is then prevented from being removed from the slot 112 by a T-nut 120 that is placed between raised ridges 121. The ridges 121 prevent the T-nut from rotating during rotation of the screw 116.

While one end of the leg support 104 is attached to the shell 22, the other free end 122 of the leg support 104 extends past the right side surface 26 and lying over the concave interior volume of space 30 while not engaging the left side surface 24. As shown in FIG. 3, the free end 122 overlies a side section 124 of the liner 32 and is inserted through an elastic sleeve 126 that is sewn to the side section 124.

The locking mechanism 114 adjusts the amount that the free end 122 of the leg support 104 extends past the right side surface 26 of the shell 22. This is done by first positioning the leg support 104 and free end 122 to a desired position by sliding the leg support 104 and slot 112 relative to the screw 116. Once the desired position is achieved, the screw 116 is tightened which causes the screw 116 to press against the shell 22 and thus causes the shell 22 to press against the leg support 104. As shown in FIG. 6, the leg support 104 has a plurality of alternating teeth 128 and grooves 130. Similarly, an exterior side of the side section 124 of the shell 22 has a plurality of teeth and grooves (not shown) that are similar to the teeth 128 and grooves 130 described previously. During the pressing of the shell 22 against the leg support 104, a number of the teeth 128 are inserted into and engage grooves of the shell 22 and a number of the teeth of the shell 22 are inserted into and engage the grooves 130 of the shell 22. The screw 116 is tightened so that the teeth and grooves of the shell 22 and leg support 104 engage one another and lock the free end 122 at a desired position. Note that the slot 112 allows the free end 122 to extend a distance from the edge of the right side surface 26 of the shell 22 that ranges from approximately 3.5 inches to approximately 5.0 inches.

Figure 7:
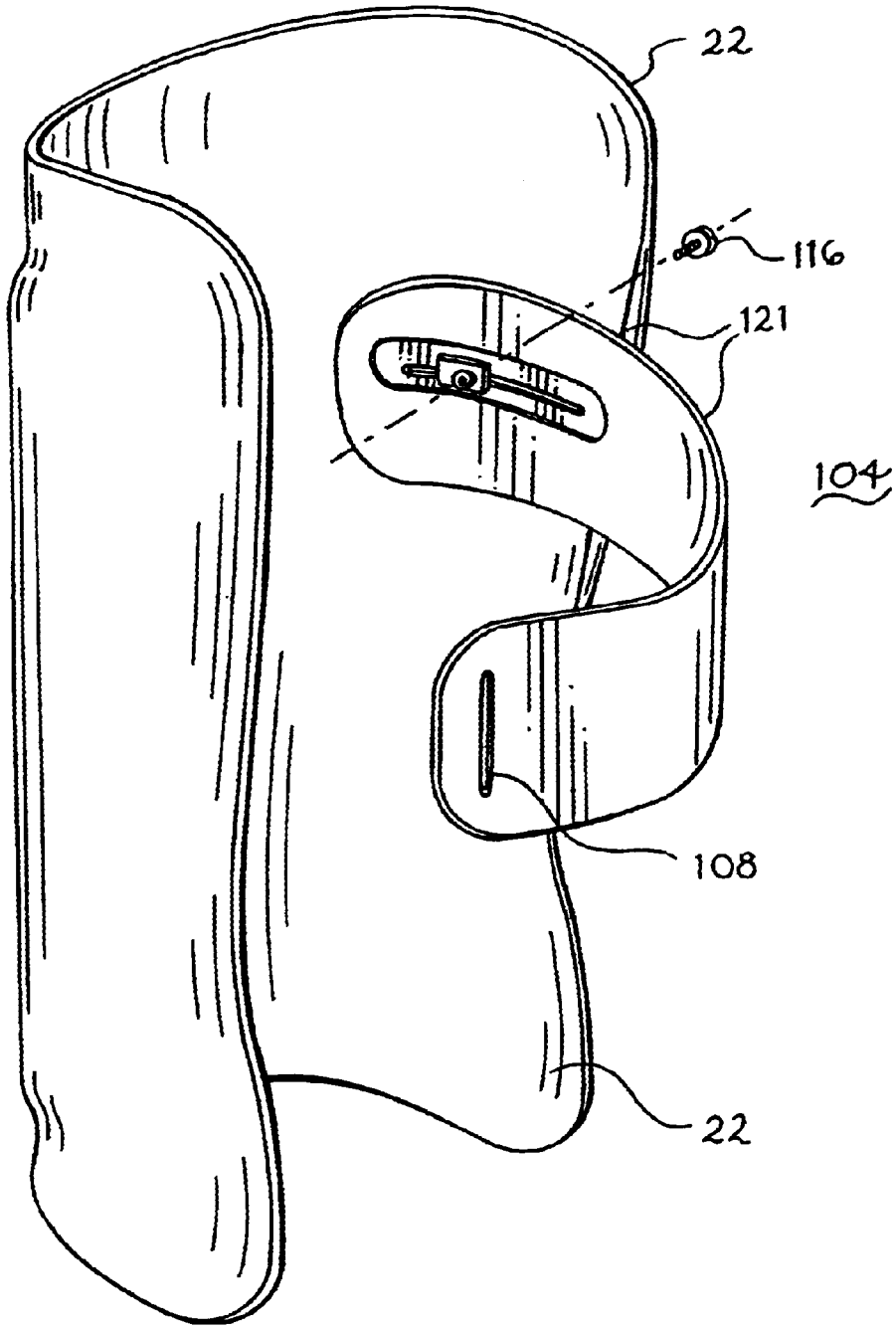
FIG. 7 schematically shows attachment of the leg support of FIGS. 5–6 to a shell of the shin guard of FIGS. 1–3.

Note that in an alternative embodiment of the locking mechanism, the teeth and grooves of the shell 22 and leg support 104, the recess portion of the shell 22 and the ridges 121 of FIGS. 5–7 are eliminated. In this embodiment, locking of the leg support 104 is accomplished by first positioning the leg support 104 and free end 122 to a desired position by sliding the leg support 104 and slot 112 relative to the screw 116. Once the desired position is achieved, the screw 116 is tightened which causes the screw 116 to press against the shell 22 and thus causes the shell 22 to press against the leg support 104. The pressure is sufficient to lock the leg support 104 in position.

In operation, the leg of a player or user is inserted into concave interior volume of space 30 of the shell 22 of the shin guard 20. Once the leg is inserted into the shell 22, the leg support 104 is moved so that the free end 122 snugly engages the inserted leg, wherein the leg support 104 does not engage the side surface 24. Upon achieving a snug fit, the leg support 104 is locked in position by tightening the screw 116 in the manner described previously for the two embodiments of the locking mechanism.

The foregoing description is provided to illustrate the invention, and is not to be construed as a limitation. Numerous additions, substitutions and other changes can be made to the invention without departing from its scope as set forth in the appended claims.

We claim:

1. A shin guard comprising:

a rigid shell comprising a first surface and a second surface that face each other and define a concave interior volume of space that extends along a longitudinal dimension of said shell;

a liner positioned within said concave interior volume of space and attached to said shell;

a heat/sweat absorber positioned within said concave interior volume of space and attached to said liner; and a V-shaped strap comprising:

a first free end attached to said first surface;

a second free end attached to said first surface; and a vertex positioned between said first free end and said second free end and attached to said second surface.

2. A The shin guard of claim 1, further comprising a kneecap shell attached to said shell.

3. The shin guard of claim 2, further comprising a kneecap insert attached to said kneecap shell.

4. The shin guard of claim 3, wherein attachment between said kneecap insert and said kneecap shell is accomplished by a hook and loop system.

5. The shin guard of claim 4, further comprising a toe guard attached to said shell.

6. The shin guard of claim 1, further comprising a toe guard attached to said shell.

7. The shin guard of claim 1, further comprising a kneecap shell attached to said liner.

8. The shin guard of claim 7, wherein said shell and said kneecap shell do not overlap one another.

9. The shin guard of claim 1, wherein said liner comprises:

a first portion that extends past said first surface and outside of said concave interior volume of space; and a second portion that extends past said second surface and outside of said concave interior volume of space.

10. The shin guard of claim 1, wherein said first free end is movable from a first position to a second position.

11. The shin guard of claim 10, further comprising a locking mechanism that locks said first free end in position between said first position and said second position.

12. A shin guard comprising:

a rigid shell comprising a first surface and a second surface that face each other and define a concave interior volume of space that extends along a longitudinal dimension of said shell; and a movable leg support comprising:

a first end attached to said shell in a non-integral manner; and a second free end, wherein said leg support moves relative to said shell from a first position to a second position where said second free end extends past said first surface and lies over said concave interior volume of space and wherein said movable leg support is made of a rigid material so that the entire leg support retains a defined shape as said leg support moves from said first position to said second position.

13. The shin guard of claim 12, wherein said movable leg support is curved.

14. The shin guard of claim 12, further comprising a locking mechanism attached to said first end of said movable leg support.

15. The shin guard of claim 14, wherein said locking mechanism comprises a pressing element that presses said shell against said leg support.

16. The shin guard of claim 12, further comprising a heat/sweat absorber positioned within said concave interior volume of space.

17. The shin guard of claim 12, wherein said leg support is only attached to said shin guard at said first end.

18. A shin guard comprising:

a shell comprising a first surface and a second surface that face each other and define a concave interior volume of space that extends along a longitudinal dimension of said shell;

a movable leg support comprising:

a first end attached to said shell; and a second free end, wherein said leg support moves relative to said shell from a first position to a second position where said second free end extends past said first surface and lies over said concave interior volume of space and wherein said movable leg support is made of a rigid material so that the entire leg support retains a defined shape as said leg support moves from said first position to said second position; and a locking mechanism attached to said first end of said movable leg support, wherein said movable leg support comprises a tooth that faces a groove formed in said shell and said locking mechanism comprises a pressing element that presses said tooth into said groove.

19. The shin guard of claim 18, wherein said pressing element comprises a screw.

20. A shin guard comprising:

a shell comprising a first surface and a second surface that face each other and define a concave interior volume of space that extends along a longitudinal dimension of said shell;

a movable leg support comprising:

a first end attached to said shell; and a second free end, wherein said leg support moves relative to said shell from a first position to a second position where said second free end extends past said first surface and lies over said concave interior volume of space and wherein said movable leg support is made of a rigid material so that the entire leg support retains a defined shape as said leg support moves from said first position to said second position; and a locking mechanism attached to said first end of said movable leg support, wherein said locking mechanism comprises a pressing element that presses said shell against said leg support and wherein said pressing element comprises a screw.

21. A shin guard comprising:

a shell comprising a first surface and a second surface that face each other and define a concave interior volume of space that extends along a longitudinal dimension of said shell; and a movable leg support comprising:

a first end attached to said shell; and a second free end, wherein said leg support moves relative to said shell from a first position to a second position where said second free end extends past said first surface and lies over said concave interior volume of space and wherein said movable leg support is made of a rigid material so that the entire leg support retains a defined shape as said leg support moves from said first position to said second position; and a V-shaped strap comprising:

a first free end attached to said first surface;

a second free end attached to said first surface; and a vertex positioned between said first free end and said second free end and attached to said second surface.

22. A shin guard comprising:

a shell comprising a first surface and a second surface that face each other and define a concave interior volume of space that extends along a longitudinal dimension of said shell; and a movable leg support comprising:

a first end attached to said shell; and a second free end, wherein said leg support moves relative to said shell from a first position to a second position where said second free end extends past said first surface and lies over said concave interior volume of space and wherein said movable leg support is made of a rigid material so that the entire leg support retains a defined shape as said leg support moves from said first position to said second position; and a kneecap shell attached to said shell.

23. The shin guard of claim 22, further comprising a kneecap insert attached to said kneecap shell.

24. The shin guard of claim 23, wherein attachment between said kneecap insert and said kneecap shell is accomplished by a hook and loop system.

25. The shin guard of claim 22, wherein said shell and said kneecap shell do not overlap one another.

26. A shin guard comprising:

a shell comprising a first surface and a second surface that face each other and define a concave interior volume of space that extends along a longitudinal dimension of said shell; and a leg support comprising:

a first end attached to said shell in a non-integral manner; and a second free end that extends past said first surface and lies over said concave interior volume of space, wherein said leg support does not engage said second surface and wherein said leg support is made of a rigid material that retains a defined shape from said first end to said second free end.

27. The shin guard of claim 26, wherein said leg support is curved.

28. The shin guard of claim 26, further comprising:

a liner positioned within said concave interior volume of space and attached to said shell.

29. The shin guard of claim 26, further comprising a foot guard attached to said shell.

30. The shin guard of claim 26, wherein said leg support is only attached to said shin guard at said first end.

31. A shin guard comprising:

a shell comprising a first surface and a second surface that face each other and define a concave interior volume of space that extends along a longitudinal dimension of said shell; and a leg support comprising:

a first end attached to said shell; and a second free end that extends past said first surface and lies over said concave interior volume of space, wherein said leg support does not engage said second surface and wherein said leg support is made of a rigid material that retains a defined shape from said first end to said second free end; and a V-shaped strap comprising:

a first free end attached to said first surface;

a second free end attached to said first surface; and a vertex positioned between said first free end and said second free end and attached to said second surface.

32. A shin guard comprising:

a shell comprising a first surface and a second surface that face each other and define a concave interior volume of space that extends along a longitudinal dimension of said shell;

a liner positioned within said concave interior volume of space and attached to said shell;

a heat/sweat absorber positioned within said concave interior volume of space and attached to said liner; and a leg support comprising:

a first end attached to said shell; and a second free end that extends past said first surface and lies over said concave interior volume of space, wherein said leg support does not engage said second surface and wherein said leg support is made of a rigid material that retains a defined shape from said first end to said second free end.

33. A shin guard comprising:

a shell comprising a first surface and a second surface that face each other and define a concave interior volume of space that extends along a longitudinal dimension of said shell;

a kneecap shell attached to said shell; and a leg support comprising:

a first end attached to said shell; and a second free end that extends past said first surface and lies over said concave interior volume of space, wherein said leg support does not engage said second surface and wherein said leg support is made of a rigid material that retains a defined shape from said first end to said second free end.

34. The shin guard of claim 33, further comprising a kneecap insert attached to said kneecap shell.

35. The shin guard of claim 34, wherein attachment between said kneecap insert and said kneecap shell is accomplished by a hook and loop system.

36. The shin guard of claim 35, further comprising a foot guard attached to said shell.

37. A shin guard comprising:

a shell comprising a first surface and a second surface that face each other and define a concave interior volume of space that extends along a longitudinal dimension of said shell;

a liner positioned within said concave interior volume of space and attached to said shell;

a kneecap shell attached to said liner; and a leg support comprising:

a first end attached to said shell; and a second free end that extends past said first surface and lies over said concave interior volume of space, wherein said leg support does not engage said second surface and wherein said leg support is made of a rigid material that retains a defined shape from said first end to said second free end.

38. The shin guard of claim 37, wherein said shell and said kneecap shell do not overlap one another.

* * * * *